US009038425B2

(12) United States Patent
Eglmeier et al.

(10) Patent No.: US 9,038,425 B2
(45) Date of Patent: May 26, 2015

(54) WASHING MACHINE COMPRISING A LAUNDRY DRUM

(75) Inventors: Hans Eglmeier, Berlin (DE); Andreas Hanau, Berlin (DE)

(73) Assignee: BSH BOSCH UND SIEMENS HAUSGERAETE GMBH, Munich (DE)

( * ) Notice: Subject to any disclaimer, the term of this patent is extended or adjusted under 35 U.S.C. 154(b) by 421 days.

(21) Appl. No.: 13/521,465

(22) PCT Filed: Dec. 30, 2010

(86) PCT No.: PCT/EP2010/070901

§ 371 (c)(1),
(2), (4) Date: Jul. 11, 2012

(87) PCT Pub. No.: WO2011/091941

PCT Pub. Date: Aug. 4, 2011

(65) Prior Publication Data

US 2012/0279263 A1 Nov. 8, 2012

(30) Foreign Application Priority Data

Jan. 28, 2010 (DE) ..... 10 2010 001 299

(51) Int. Cl.
*D06F 37/20* (2006.01)
*D06F 33/02* (2006.01)
(Continued)

(52) U.S. Cl.
CPC ..... *D06F 37/22* (2013.01); *D06F 33/02* (2013.01); *D06F 37/04* (2013.01); *D06F 37/20* (2013.01)

(58) Field of Classification Search
CPC ..... D06F 37/22; D06F 37/04; D06F 37/20; D06F 33/02
USPC ..... 68/23 R, 23.1, 23.2, 23.3, 23.4, 23.5, 68/23.6, 23.7, 24, 139, 140, 141, 142
See application file for complete search history.

(56) References Cited

U.S. PATENT DOCUMENTS 2,510,836 A * 6/1950 Russell et al. ..... 68/23.1
2,579,472 A * 12/1951 Chamberlin et al. ..... 68/23.1
(Continued)

FOREIGN PATENT DOCUMENTS

DE 1772023 U 8/1958
DE 3134633 A1 6/1982
(Continued)

OTHER PUBLICATIONS

International Search Report PCT/EP2010/070901.
(Continued)

*Primary Examiner* — Joseph L Perrin
(74) *Attorney, Agent, or Firm* — Nixon & Vanderhye, P.C.

(57) ABSTRACT

A washing machine includes a laundry drum which is rotatably mounted inside a tub. The tub is connected in a fixed manner within a surrounding housing. The axis of rotation of the laundry drum is variable in height with respect to the tub. Elastic elements are positioned outside the tub to suspend the laundry drum together with a drive unit within the housing in an oscillating manner. The presence of a relatively high water consumption of the washing machine can be avoided and the relative position of the laundry drum with respect to the tub can be adjusted by providing a position-adjusting device, by which the height and/or the angle of the axis of rotation can be adjusted within limits, and which engages with a part that is connected in a fixed manner to the bearing for the drive shaft of the laundry drum.

12 Claims, 1 Drawing Sheet

(51) Int. Cl.
*D06F 37/22* (2006.01)
*D06F 37/04* (2006.01)

(56) References Cited

U.S. PATENT DOCUMENTS

| | | | | |
|---|---|---|---|---|
| 2,629,245 | A * | 2/1953 | Chamberlin | 68/23.1 |
| 2,836,046 | A * | 5/1958 | Smith | 68/23.2 |
| 3,089,326 | A * | 5/1963 | Belaieff | 68/23.2 |
| 6,151,930 | A * | 11/2000 | Carlson | 68/12.06 |
| 6,286,344 | B1 * | 9/2001 | Jeon et al. | 68/23.1 |
| 6,557,383 | B1 * | 5/2003 | Ito et al. | 68/23.2 |
| 6,974,000 | B2 * | 12/2005 | Carlson et al. | 188/267.2 |
| 7,530,244 | B2 * | 5/2009 | Inuzuka et al. | 68/24 |
| 7,536,882 | B2 * | 5/2009 | Kim et al. | 68/24 |
| 7,591,155 | B2 * | 9/2009 | Chang | 68/139 |
| 2004/0231374 | A1 * | 11/2004 | Chang et al. | 68/23.3 |
| 2005/0022315 | A1 * | 2/2005 | Beier et al. | 8/158 |
| 2006/0010935 | A1 * | 1/2006 | Park et al. | 68/3 R |
| 2007/0074543 | A1 * | 4/2007 | Lim et al. | 68/140 |
| 2007/0089245 | A1 * | 4/2007 | Kim et al. | 8/158 |
| 2007/0227200 | A1 * | 10/2007 | Kim et al. | 68/140 |
| 2009/0044574 | A1 * | 2/2009 | Lim et al. | 68/23.1 |
| 2010/0154130 | A1 * | 6/2010 | Han et al. | 8/158 |

FOREIGN PATENT DOCUMENTS

| | | | |
|---|---|---|---|
| EP | 1433890 | A2 | 6/2004 |
| JP | 2006136599 | A | 6/2006 |
| JP | 2009039319 | A | 2/2009 |

OTHER PUBLICATIONS

German Search Report DE 10 2010 001 299.8.

* cited by examiner

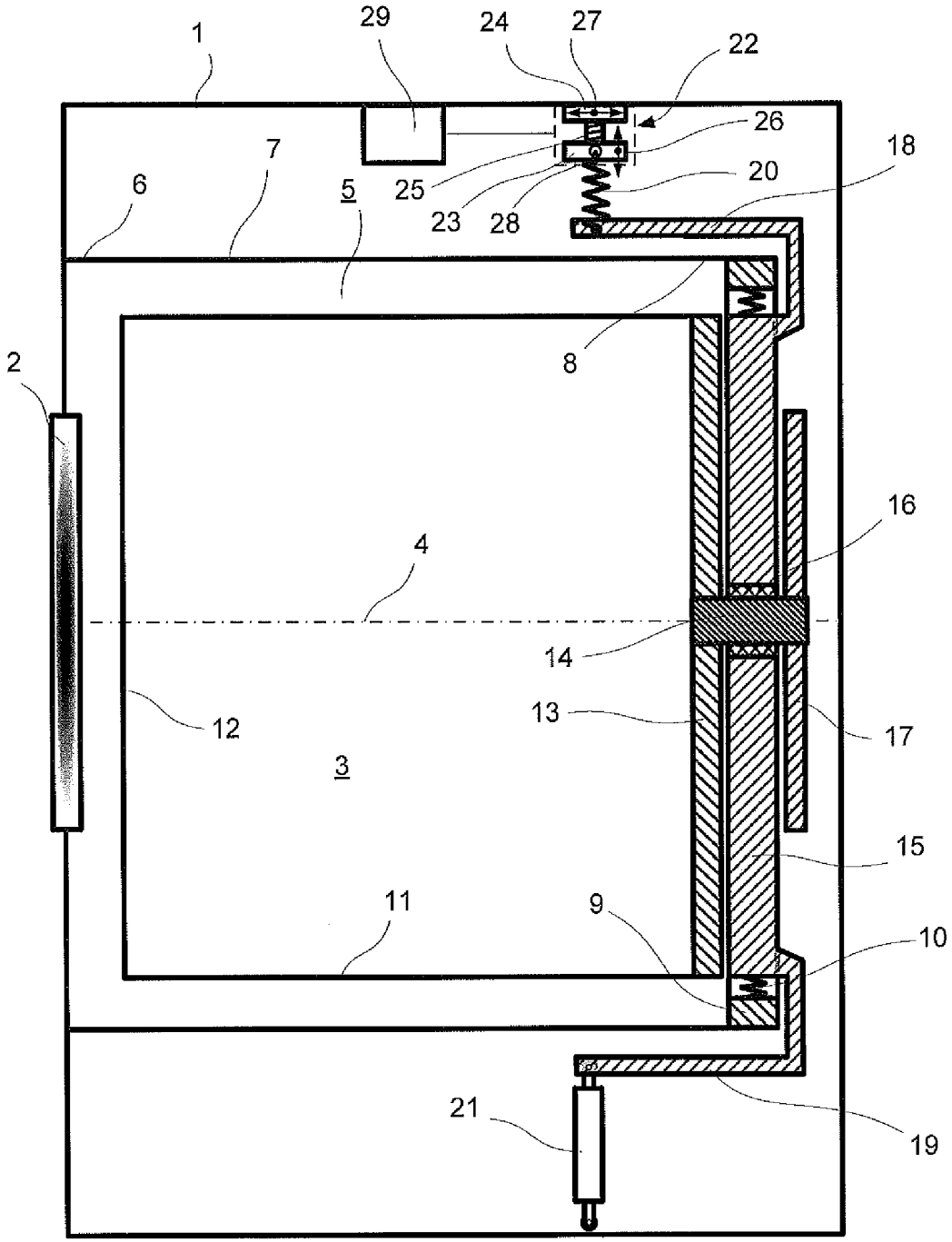
1
29
24
27
22
26
18
7
6
5
25
20
23
28
8
2
16
4
14
12
13
17
3
15
11
9
10
21
19

WASHING MACHINE COMPRISING A LAUNDRY DRUM

This application is a U.S. National Phase of International Patent Application No. PCT/EP2010/070901, filed Jun. 24, 2010, which designates the U.S. and claims priority to German Patent Application No. DE 10 2010 001 299.8, filed Jan. 28, 2010, the entire contents of each of which are hereby incorporated by reference.

BACKGROUND OF THE INVENTION

The invention relates to a washing machine having a laundry drum, which is rotatably supported within a tub, which is connected in a fixed manner within an enclosing housing, the axis of rotation of the laundry drum being variable in height in relation to the tub, and said laundry drum, together with a drive unit, being suspended in an oscillating manner within the housing by elastic elements positioned outside the tub.

Such a washing machine is known from EP 1 433 890 A2. An oscillation space with sufficiently large dimensions is provided for the laundry drum within the tub therein, so that the elastically movable laundry drum can rotate freely in all the laundry treatment program segments, without touching any parts in the tub, e.g. the heating elements. The distance between the wall parts of the laundry drum and those of the tub is therefore much greater than in conventional washing machines, in which the entire tub, together with the laundry drum, can move in an oscillating manner within the housing but the laundry drum can only rotate freely within the tub. Compared with such conventional washing machines therefore in washing machines according to EP 1 433 890 A2 the quantity of water present in the tub is much higher, resulting in an increase in water consumption, which should instead preferably be reduced.

BRIEF SUMMARY OF THE INVENTION

The object of the invention is therefore to design a washing machine of the type mentioned in the introduction so that on the one hand the disadvantage of higher water consumption is avoided while on the other hand the relative position of the laundry drum to the tub can be adjusted.

According to the invention this object is achieved by the characterizing portion of claim 1 in that a position adjusting facility, by means of which the height and/or angle of the axis of rotation can be set within limits, engages with a part connected in a fixed manner to the bearing for the drive shaft of the laundry drum. This allows the relative position of the laundry drum to the tub to be set so that only so much water has to be present in the tub as in conventional washing machines. The possibility of setting the height and in some instances also the angle of the axis of rotation individually also makes it possible to set the relative position of the laundry drum as a function of the respective laundry treatment program segment. Since the movement of the laundry drum in the active wash phase segment is rarely as great as during spinning, the height of the drum can be set to be smaller in the active wash phase than during spinning. This allows the quantity of water involved in the washing process to be kept correspondingly small but the distance during spinning can be selected to be great so that deflections of an out of balance laundry drum do not cause damage and there is a large amount of space for the spun off wash liquor.

In one advantageous development of the invention the design of the washing machine is such that the laundry drum has a rigid rear wall at its rear, which is connected in a fixed manner to the drive shaft of a drum drive, which is supported in a support disk, and the tub is formed essentially from a shell part, which is connected in a fixed and leaktight manner to the housing at the front and forms an opening with an edge of the shell part at the rear, into which opening the laundry drum is introduced into the tub from behind, its support disk being connected in a sealing manner to the edge of the shell part by way of an annular diaphragm. Designs incorporating such measures provide the most favorable conditions for the positioning of the position adjusting facility.

If, according to a further development, at least two support arms are connected to the support disk, engaging over the edge of the shell part and extending forward outside the tub, roughly parallel to the contour of the shell part, and being connected in an articulated manner to the housing by way of elastic connections, the position adjusting facility can engage indirectly with the part connected in a fixed manner to the bearing.

In such an instance according to one embodiment of the invention the position adjusting facility can advantageously be incorporated between at least one of the elastic connections and the housing and have two degrees of freedom for setting, namely one in the direction of the depth of the housing and a second in the direction of the height of the housing. This allows the setting options to be separated from one another so that the height and angle can be set independently of one another.

It is thus possible to assign the degree of freedom in the direction of the height of the housing to the possibility of setting the height of the axis of rotation of the laundry drum in relation to the tub and/or to assign the degree of freedom in the direction of the depth of the housing to the possibility of setting the angle of the axis of rotation of the laundry drum.

As mentioned above it is possible, with a washing machine having a program control facility and program sequences stored therein for at least one active wash phase and for at least one spin phase, for a respectively assigned dimension to be predetermined in the program control facility for the height and/or angle position of the axis of rotation of the laundry drum as a function of the program sequences. If in an active wash phase segment minor heightwise movement of the laundry drum is expected, in such a program segment the dimension for the lowering of the axis of rotation of the laundry drum can be so great that the lower crown of the laundry drum is only a short distance from the base of the tub. The so-called active quantity of wash liquor can then also be kept small—as is generally desirable. On the other hand the laundry drum should be able to move up and down to a greater degree during spinning. Therefore the height and/or angle position of the axis of rotation can be set accordingly so that the lower crown of the laundry drum is at a sufficiently large distance from the base of the tub for contact with parts of the tub to be avoided and for there to be sufficient space for the spun off quantity of wash liquor.

Further advantageous embodiments of the invention will emerge individually or in combination with one another as a result of measures from the subclaims and from the description.

BRIEF DESCRIPTION OF THE DRAWINGS

The invention is described in more detail based on an exemplary embodiment illustrated in the drawing, in which the single FIGURE shows a lateral view through the housing of an inventively configured washing machine having a fixed tub and a laundry drum disposed therein in an oscillating manner.

DETAILED DESCRIPTION OF EXEMPLARY EMBODIMENTS OF THE PRESENT INVENTION

The housing 1 of the washing machine has a front door 2 for loading and unloading the laundry drum 3, which is supported within a tub 5 in such a manner that it can rotate about an axis of rotation 4. The tub 5 is connected at its front end 6 in a fixed and sealing manner to the housing. In the closed state the door 2 is also leaktight. The tub 5 has a shell part 7, which is essentially cylindrical in shape. Its rear end 8 transitions into an annular edge 9, which is reinforced and as a result can absorb motion forces which can be transmitted to it by way of a diaphragm 10.

The laundry drum 3 also has a cylindrical shell 11, which is closed off at the front by an end base 12 open to door 2 and at the rear by a rigid rear wall 13. Configuring the shell 11 with an end base 12 and a rigid rear wall 13 makes the laundry drum 3 overall a very rigid structure, which can be supported in a mobile manner by means of a stable drive shaft 14. To this end a bearing 16 with two bearing planes is provided in the support disk 15, guiding the drive shaft 14 through the support disk 15 to a drive 17. This drive is only shown schematically and can be a belt transmission for a drive motor (not shown), a direct drive motor or similar.

The diaphragm 10 is tensioned between the periphery of the support disk 15 and the edge 9 of the tub 5. It serves primarily to seal the tub 5 off from its environment. However this seal must also be elastic so that the support disk 15 coupled to the laundry drum 3 by way of the drive shaft 14 can also move in relation to the tub 5. Said support disk 15 has at least two support arms 18 and 19 on its periphery, engaging over the edge 9 of the tub 5 and extending at least approximately parallel to the contour of the shell part 7 of the tub 5 to the front of the housing 1. In another example the support disk 15 can operate adequately with just one support arm 18 or 19, if a so-called suspension strut, a combination of spring and shock absorber (not shown), engages here, or can have more than two support arms 18 and 19, if the engagement of spring action and absorption is to be distributed in a more differentiated manner. These support arms 18 and 19 hold the laundry drum at a specific height and angle position within the housing 1 and within the tub 5.

Elastic connections 20 and 21 serve for this purpose, the connection 20 being represented by one or more springs, while the connection 21 is characterized by one or more shock absorbers. The shock absorbers 21 operate as in conventional washing machines. The springs 20 in the present example are however each connected to the housing 1 by way of a position adjusting facility 22. This position adjusting facility consists essentially of a height adjusting block 23 that can be raised and lowered, a length adjusting block 24 and a threaded spindle 25 connecting the two. The threaded spindle 25 can be rotated in a manner not shown in detail here so that the height adjusting block 23 can be raised and lowered, providing the degree of freedom 26 in the direction of the of the heightwise positioning of the axis of rotation 4. This allows the height position of the axis of rotation 4 to be set in relation to the tub 5. The length adjusting block 24 can be set in a manner not shown in detail here to a depthwise position in relation to the housing 1—in other words in the direction of the degree of freedom 27 in the direction of depthwise positioning with the housing 1—so that the connecting point 28 between the spring 20 and the height adjusting block 23 is moved to a greater or lesser degree into the depth of the housing, thereby influencing the angle position of the axis of rotation 4 of the laundry drum 3.

Any number of different types of position adjusting facilities can be used to being about the height and angle position setting of the axis of rotation 4 of the laundry drum 3. They all come within the scope of the concept of the invention characterized in claim 1. Similarly the embodiment of the rear wall 13 and the support disk 15 and of the support arms 18 and 19 is only shown schematically here and will be adjusted to the structural conditions of the washing machine in question when implementing the inventive measures. The same applies to corresponding adjusting measures at the door 2, at the connection of the opening in the end base 12 and for the embodiment of the tub 5 and the elastic connections 20 and 21 and the drum drive.

The advantages of an inventive washing machine compared with known washing machines are manifold. Since the distance between the shell 11 of the laundry drum 3 and the shell part 7 of the tub 5 at the base of the tub 5 can be reduced during washing and rinsing and changed to a specific, greater value for spinning, it is also possible to reduce the so-called inactive fluid—i.e. the wash liquor not bound up in the laundry—considerably.

The new washing machine can be equipped with novel method-related features. For example very delicate textiles can be immersed with very little or no drum rotation during washing. A spin/rinse program can be utilized, in which the laundry is rinsed in the rinse program segment by being repeatedly immersed with a low drum position and the wash liquor is spun off with a higher drum position. It is possible to influence the laundry drop in rotating mode by adjusting the inclination of the laundry drum 3. To this end the inclination can be adjusted in a fixed manner in each instance, even with a negative angle of inclination, or it can oscillate. The variable inclination of the laundry drum can also be used as a method element of an operating program, in addition to drum rotation.

The fixed position of the tub 5 means that it is structurally simpler to connect buffers for rinse liquor to the tub 5. The adjustable height position, inclination and fixing of the laundry drum 3 mean that the laundry drum can be loaded and unloaded in an ergonomically more favorable manner. This makes it easier to use than the standard washing machines on the market. In the case of structural components in or on the tub 5, for which their distance from the drum shell 11 of the laundry drum 3 is a critical parameter, e.g. when using inductive heating for the shell of the laundry drum, it is of major advantage that this distance can be set precisely by adjusting the height of the laundry drum 3.

The invention claimed is:

1. A washing machine, comprising:

a housing;

a tub connected in a fixed manner within the housing;

a drive unit having a drive shaft;

a laundry drum rotatably supported by the drive shaft within the tub and defining an axis of rotation which is variable in height in relation to the tub;

a bearing for support of the drive shaft;

elastic elements positioned outside the tub to suspend the laundry drum together with the drive unit within the housing in an oscillating manner; and a position adjusting facility engaging with a part which is connected in a fixed manner to the bearing for the drive shaft of the laundry drum for setting at least one of a height and an angle of the axis of rotation within limits;

wherein the position adjusting facility is configured to selectively set at least one of the height or the angle of the axis of rotation to place the drum at a selectively variable distance from the tub, the distance corresponding to a respective laundry treatment program segment.

2. The washing machine of claim 1, wherein the laundry drum has a rear formed with a rigid rear wall which is connected in a fixed manner to the drive shaft of the drive unit, said part being constructed as a support disk to support the drive shaft, said tub being formed essentially from a shell part, which is connected in a fixed and leaktight manner to the housing at a front and forms with an edge of the shell part at the rear an opening into which the laundry drum is introduced into the tub from behind, and further comprising an annular diaphragm for connecting the support disk in a sealing manner to the edge of the shell part.

3. The washing machine of claim 2, wherein the support disk includes at least two support arms which engage over the edge of the shell part and extend forward outside the tub in roughly parallel relation to a contour of the shell part, said support arms being connected in an articulated manner to the housing by the elastic elements.

4. The washing machine of claim 1, wherein the position adjusting facility engages with the part connected in a fixed manner to the bearing.

5. The washing machine of claim 1, wherein the position adjusting facility is incorporated between at least one of the elastic elements and the housing and has two degrees of freedom for setting, a first degree of freedom in the direction of a depth of the housing, a second degree of freedom in the direction of a height of the housing.

6. The washing machine of claim 5, wherein the second degree of freedom is assigned to set the height of the axis of rotation of the laundry drum in relation to the tub.

7. The washing machine of claim 5, wherein the first degree of freedom is assigned to set the angle of the axis of rotation of the laundry drum.

8. The washing machine of claim 1, wherein the distance between the tub and the drum is minimized during a laundry wash cycle; the wash cycle being configured to use a minimum amount of water necessary for an effective wash cycle.

9. The washing machine of claim 1, wherein the distance between the tub and the drum is maximized during a spin phase; the drum position being selected such that an out of balance laundry drum does not cause damage during the spin phase.

10. The washing machine of claim 1, wherein the angle of the axis of rotation is adjusted relative to horizontal.

11. The washing machine of claim 1, wherein the amount of water desired in the drum is a function of the water necessary for a portion of the laundry treatment cycle.

12. A washing machine, comprising:

a housing;

a tub connected in a fixed manner within the housing;

a drive unit having a drive shaft;

a laundry drum rotatably supported by the drive shaft within the tub and defining an axis of rotation which is variable in height in relation to the tub;

a bearing for support of the drive shaft;

elastic elements positioned outside the tub to suspend the laundry drum together with the drive unit within the housing in an oscillating manner; and a position adjusting facility engaging with a part which is connected in a fixed manner to the bearing for the drive shaft of the laundry drum for setting at least one of a height and an angle of the axis of rotation within limits;

wherein the position adjusting facility is configured to selectively set at least one of the height or the angle of the axis of rotation to place the drum at a selectively variable distance from the tub, the distance corresponding to a respective laundry treatment program segment.

* * * * *